US005938802A

United States Patent [19]

Saito et al.

[11] Patent Number: 5,938,802

[45] Date of Patent: Aug. 17, 1999

[54] EXHAUST GAS PURIFIER

[75] Inventors: Hidetoshi Saito; Katsuhiko Yoro; Shiro Nakajima; Noboru Yamasaki, all of Itami, Japan

[73] Assignee: Sumitomo Electric Industries, Ltd., Osaka, Japan

[21] Appl. No.: 08/951,469

[22] Filed: Oct. 16, 1997

[30] Foreign Application Priority Data

Oct. 18, 1996 [JP] Japan ..... 8-275986

[51] Int. Cl.[6] ..... B01D 46/04

[52] U.S. Cl. ..... 55/282.3; 55/525; 55/DIG. 30

[58] Field of Search ..... 55/DIG. 30, 525, 55/282.3; 60/311

[56] References Cited

U.S. PATENT DOCUMENTS

| | | | |
|---|---|---|---|
| 4,276,066 | 6/1981 | Bly et al. | 55/DIG. 30 |
| 4,376,637 | 3/1983 | Yang | 55/DIG. 30 |
| 4,503,672 | 3/1985 | Stark et al. | 55/DIG. 30 |
| 4,897,096 | 1/1990 | Pischinger et al. | 55/DIG. 30 |
| 4,925,463 | 5/1990 | Kuhnert | 55/DIG. 30 |
| 5,207,807 | 5/1993 | Manfre et al. | 55/DIG. 30 |
| 5,457,945 | 10/1995 | Adilleta | 55/DIG. 30 |

FOREIGN PATENT DOCUMENTS

| | | |
|---|---|---|
| 2-27107 | 1/1990 | Japan . |
| 3-258911 | 11/1991 | Japan . |
| 4-42214 | 4/1992 | Japan . |
| 5-79317 | 3/1993 | Japan . |

*Primary Examiner*—Duane S. Smith
*Attorney, Agent, or Firm*—McDermott, Will & Emery

[57] ABSTRACT

An exhaust gas purifier which can regenerate its trapper for trapping particulate matter (PM) in exhaust over the entire area of its filter portion, even if a large amount of PM is trapped. PM trapped on the trapper is burned by heating the trapper with an electric heater inserted in the trapper on its downstream side. With this arrangement, PM is less likely to accumulate between the electric heater and the trapper. Also, PM is less likely to adhere to the surface of heater supporting insulators. Thus, it is possible to prevent short-circuiting between the heater and the trapper through PM.

6 Claims, 3 Drawing Sheets

EXHAUST GAS PURIFIER

BACKGROUND OF THE INVENTION

This invention relates to an exhaust gas purifier provided in the exhaust line of an engine and including a trapper which can be regenerated with increased efficiency.

Exhaust gas produced by a diesel engine contains particulates which are mainly carbon. Such particulate matter (hereinafter called PM) is a major cause of air pollution. To remove PM, various means have been developed.

One such conventional exhaust purifier that is now practically used includes a trapper made of a porous ceramic material, and an electric heater for burning PM trapped on the trapper to regenerate the trapper, i.e. to improve the flow of exhaust through the trapper. Lately developed trappers include cylindrical metallic porous members.

These trappers are actually filters which trap PM mainly on their surfaces at the exhaust incoming side.

Among such exhaust gas purifiers is one with electric heaters for regenerating the trapper provided opposite the front face of the trapper (unexamined Japanese patent publication 3-258911). Unexamined Japanese patent publication 2-27107 proposes to burn trapped PM by producing arc discharge between the trapper and electrodes (or conductors) inserted in deep exhaust passages formed in the trapper. It has been believed that these devices can burn trapped PM efficiently because PM is trapped mostly on the front side of the trapper. But we have found out that some part of PM penetrates deep into the trapper, and such PM is difficult to burn during regeneration.

Further, the device of unexamined Japanese patent publication 2-27107 has the possibility of arc discharge occurring unevenly in the inlet passage, which in turn increases the possibility of uneven burning of trapped PM. Another conventional device in which the electrodes of the above publication are replaced with electric heaters has a problem in that the heaters can short-circuit through trapped PM. Short-circuiting increases the possibility of uneven burning of PM.

In order to solve these problems, unexamined Japanese publication 5-79317 proposes to provide a first exhaust passage in the center of a third passage through which exhaust gas that has passed through the filter flows. The first passage is adapted to be opened during regeneration. When the first passage is opened, flame propagation is promoted due to eject effect. This improves the regeneration efficiency.

The device of unexamined Japanese utility model publication 4-42214 has a first electric heater provided at upstream side of the trapper and a second electric heater provided at its downstream side. The second heater burns any PM that has not been burned by the first heater.

Unexamined Japanese patent publication 5-79317 aims to regenerate the trapper efficiently while limiting the power consumption of the heaters to a minimum. In this arrangement, the exhaust passage has a double structure. A throttle valve is needed to open and close the inner first exhaust passage. Thus, the device is complicated in structure. Since the heater is provided in close proximity to the inner surface of the trapper, the heaters may be heated excessively while burning PM.

The device of unexamined Japanese utility model publication 4-42214 needs two heaters. This device is not suitable for use in a car because the capacity of the car battery is not enough to energize two heaters.

An object of this invention is to solve these problems and provide an exhaust gas purifier which can regenerate the trapper efficiently.

SUMMARY OF THE INVENTION

According to this invention, the electric heater for regenerating the trapper of the exhaust gas purifier is mounted in the case on a downstream side of the trapper.

The filter portion of the trapper is preferably made of a porous metallic material because this makes it possible to trap PM three-dimensionally (i.e. trap in the thickness direction of the filter, too), so that the filter portion is less likely to be clogged with PM.

Preferably, the electric heater should be a plate-shaped heater provided opposite the surface of the filter portion of the trapper. Also, the trapper is preferably formed with a plurality of recesses penetrating inwardly and alternately from the upstream and downstream sides of the trapper. If there are provided a plurality of recesses extending from the downstream side toward upward side, the electric heater may be inserted in only one of the recesses penetrating from the downstream into upstream side of the trapper. If the recesses are concentrically arranged annular ones, the electric heater should be inserted only in the outermost one of the recesses penetrating from the downstream into upstream side of the trapper.

A metallic trapper can efficiently conduct heat from the heater to the necessary parts thereof, so that PM trapped can be ignited easily. But since it is a good conductor, a metallic trapper tends to be electrically connected with the heater through PM stuck on the surfaces of the filters and the insulating heater supports, causing short-circuiting. Short-circuiting in turn causes uneven heating and burning, leaving trapped PM partially unburned. That is, the regeneration efficiency of the trapper deteriorates.

According to this invention, in order to solve this problem, an electric heater is provided on the downstream side of the trapper. With this arrangement, even if an excessive amount of PM is trapped, no PM will accumulate around the heater. It is thus possible to prevent short-circuiting between the heater and the trapper.

As described above, a metallic trap is a good heat conductor. When PM is ignited by the heat from the heater, flame propagates from the downstream toward upstream side. It is thus possible to burn PM even on the upstream side where there is no heater. By forming the filter portion of the trapper from a porous metal, it is possible to trap PM three-dimensionally. That is, PM penetrates into the filter in the thickness direction, too. PM can thus be more easily ignited by heating from downstream side.

In order to trap PM three-dimensionally, the average size of pore of the filter should be enough larger than that of PM. The average size of PM is from 0.01 to 5 $\mu$m, so that the average size of the pore should be more than 5 $\mu$m.

By arranging a plate-shaped electric heater so that their surfaces are opposed to the surfaces of the filter portion, the latter can be heated more uniformly, so that PM can be burned more uniformly.

By inserting a heater in a recess penetrating from the downstream side of the trapper into its upstream side, regeneration will proceed more smoothly between upstream and downstream of the trapper.

In the arrangement in which PM is burned utilizing flame propagation, a small number of heaters have only to be provided at PM ignition points. Heaters can thus be saved and easily mounted in the filter.

By inserting a heater into the outermost one of a plurality of concentrically arranged annular recesses formed in the filter, the heat produced by the heater is trapped inside, so that the trapper can be regenerated with high efficiency, in spite of exceptionally simple structure of the entire device.

Other features and objects of the present invention will become apparent from the following description made with reference to the accompanying drawings, in which:

DETAILED DESCRIPTION OF THE PREFERRED EMBODIMENT

Figure 1:
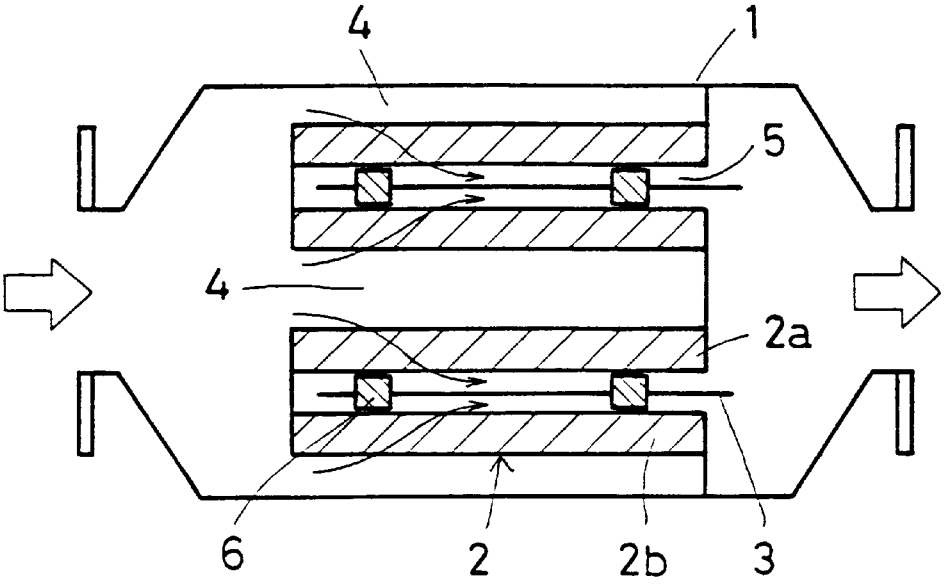
FIG. 1 is a schematic view of one embodiment of the exhaust gas purifier according to this invention.

FIG. 1 schematically shows an exhaust gas purifier embodying this invention. Numeral 1 in the figure is a case mounted in the exhaust line (or pipe) of an engine. The device of FIG. 1 comprises a trapper 2 and an electric heater 3 both mounted in the case 1.

The trapper 2 comprises two concentrically arranged cylindrical filters 2*a*, 2*b* having different diameters from each other and made from a metallic porous body made of Ni—Cl—Al alloy. And the average diameter of the pore of the filter is 300 $\mu$m.

On the upstream side, the inlet of the gap between the two filters is closed. On the downstream side, the end opening of the inner filter 2*a* and the outlet of the gap between the outer filter 2*b* and the case 1 are closed. Thus, the trapper 2 has recesses 4 penetrating from the upstream side into downstream side around the outer filter 2*b* and inside the filter 2*a*, and a recess 5 penetrating from the downstream side into upstream side between the filters 2*a* and 2*b*.

The recess 5 is an exhaust-outgoing passage. Inserted in the recess 5 is a flat cylindrical electric heater 3 having its inner and outer surfaces facing substantially the entire outer and inner surfaces of the filters 2*a* and 2*b*, respectively. The electric heater 3 is fixed to the trapper by ceramic insulating supports 6, and connected to the car battery. The heater 3 is thus energized and heated by the battery power for regeneration of the trapper.

Exhaust gas is introduced into the exhaust gas purifier shown in FIG. 1 from the lefthand side of the figure, flows through the recesses 4, filters of the trapper, and recesses 5, and exits the case through its outlet.

While exhaust is flowing through the trapper, PM therein is trapped by the filters 2*a*, 2*b*, accumulating mainly on the filter surfaces on the inlet side. PM thus scarcely adheres to the surfaces of the insulating supports 6 or accumulates between the filters and the heater 3. This eliminates the possibility of shortcircuiting between the heater and the trapper through PM, so that the filters can be regenerated uniformly.

The device shown in FIG. 1 was prepared and mounted in the exhaust line of an engine almost stopped engine to trap PM until the engine stopped due to excessive increase in pressure loss. The trapper was then regenerated. During regeneration, any local temperature rise due to short-circuiting or partial burning of PM was not observed. The trapper was thus regenerated sufficiently over the entire area thereof.

Figure 2:
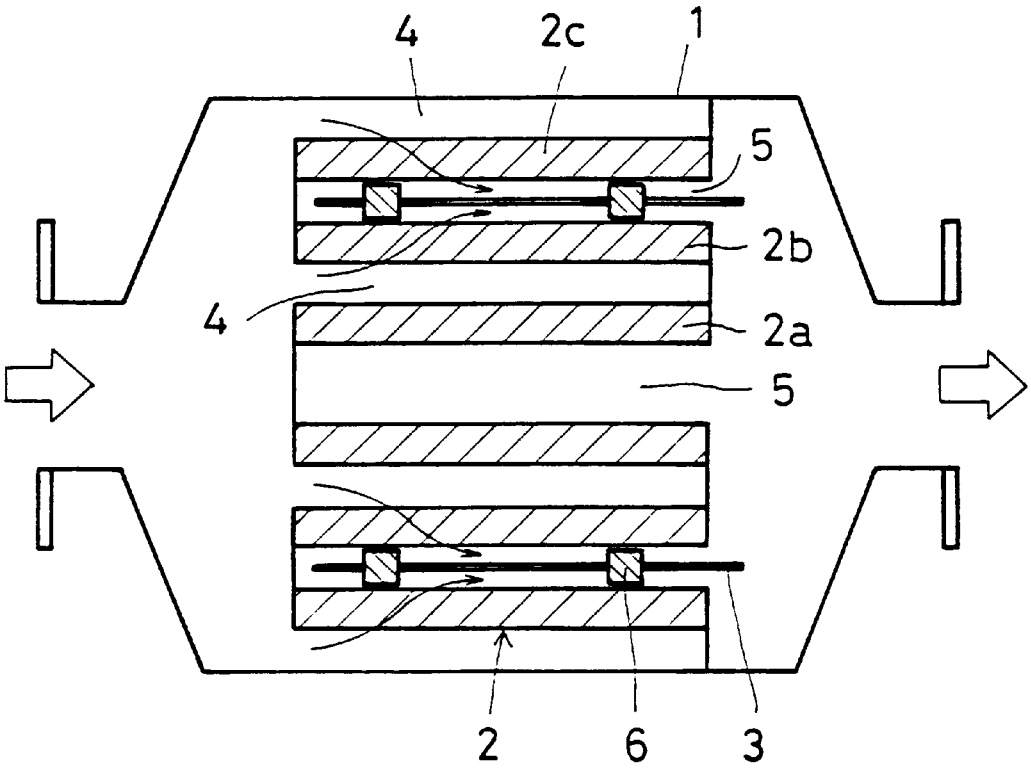
FIG. 2 is a schematic view of another embodiment.

FIG. 2 schematically shows the second embodiment. The exhaust purifier of this embodiment has a trapper 2 comprising three (or more) concentrically arranged cylindrical filters 2*a*, 2*b*, 2*c* having different diameters from one another and made from the same material as the filters of FIG. 1. Necessary parts thereof are closed to form a trapper 2. This trapper has a plurality of recesses 5 as exhaust-outgoing passages. An electric heater 3 is inserted not in all recesses but only in the outer recess 5. In this arrangement, heat generated is trapped inside the trapper, so that PM trapped on the filter 2*a* is ignited as reliably as and regenerated as efficiently as when heaters are inserted in all recesses 5.

Figure 3A:
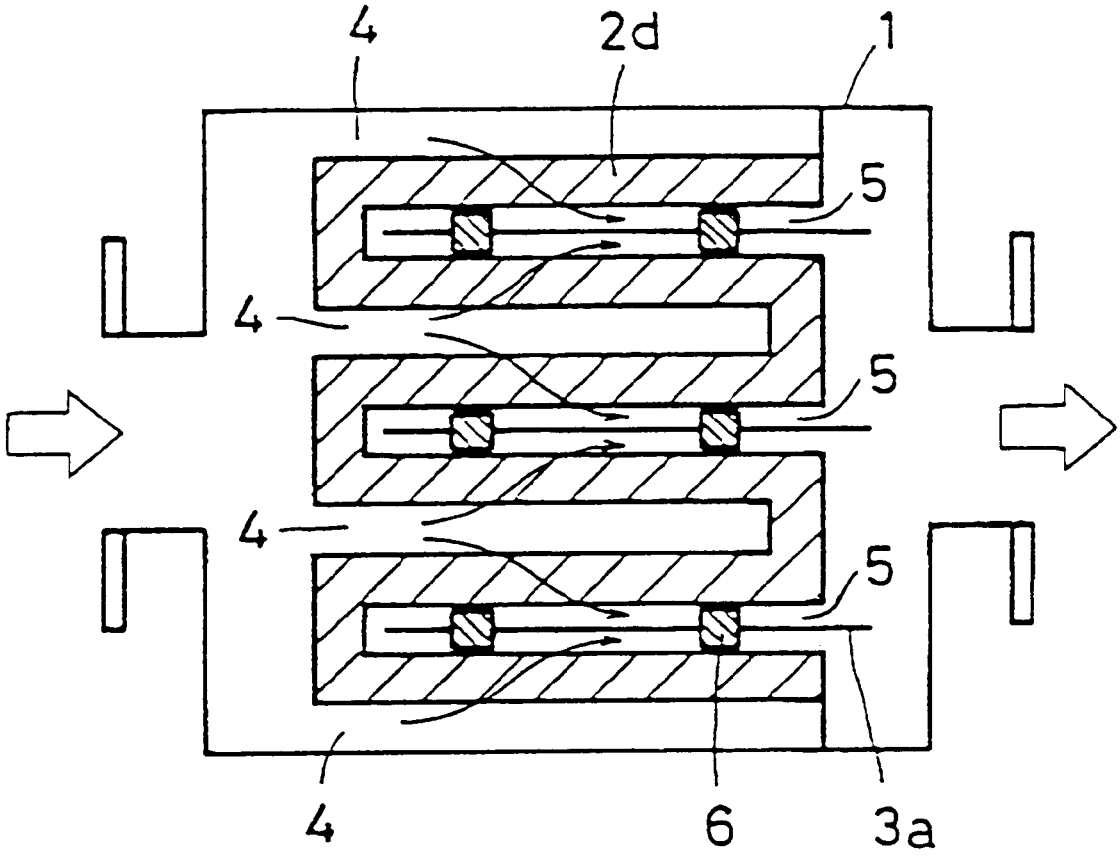
FIGS. 3*a* and 3*b* illustrate embodiment.
Figure 3B:
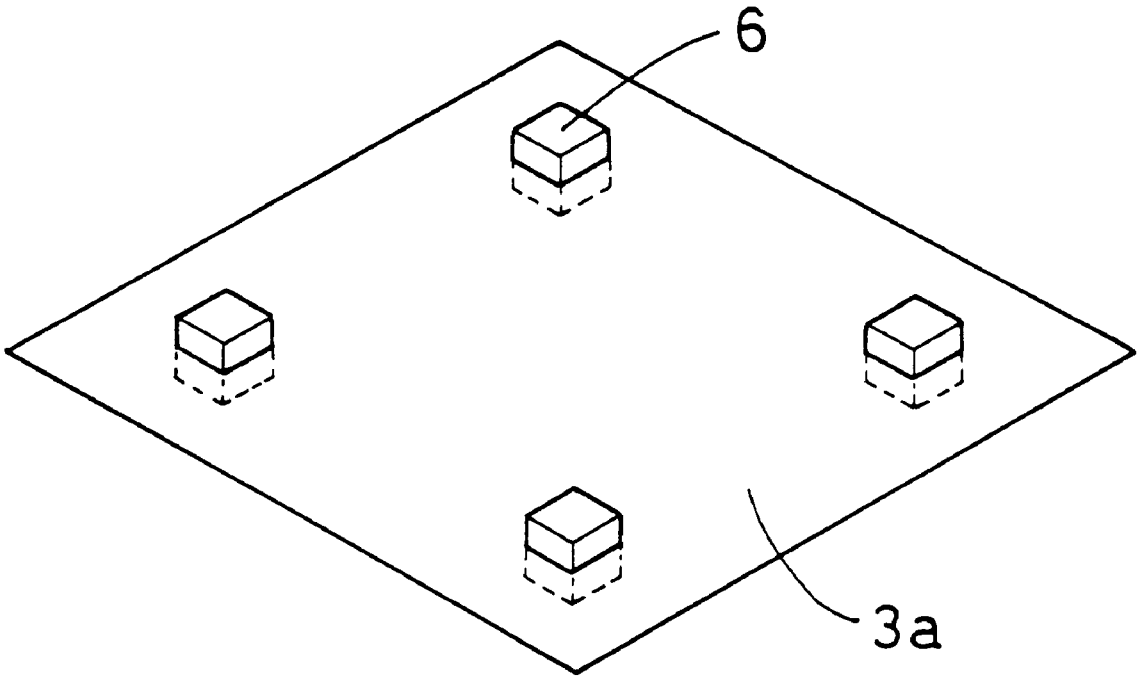

FIG. 3 schematically shows the third embodiment. The exhaust gas purifier of this embodiment has a trapper 2 formed by bending a flat filter 2*d* alternately in opposite ways and closing the gaps between both ends of the filter and the case so as to form recesses 4 and 5 arranged alternating with each other. Electric heaters 3 are inserted in the recesses 5 and fixed in position by the insulating supports 6. This device was as high in regenerating efficiency as the devices of the other embodiments.

The device of FIG. 1 or 2, made up of cylindrical filters, can maintain high filter strength. But instead of the cylindrical filters, square tube-shaped filters may be used.

As described above, according to the present invention, electric heaters for regenerating the trapper are provided on the downstream side of the trapper. It is thus possible to regenerate the trap over the entire area thereof by burning PM trapped with a minimum number of heaters. Even if an excessively large amount of PM is trapped, no short-circuiting will occur between the heaters and the trapper. This ensures efficient regeneration of the trapper. This device is especially suited for use as an exhaust gas purifier for an automobile, whose battery power is limited, and in which regenerating conditions (such as the amount of PM trapped when the trapper is regenerated) tend to vary.

What is claimed is:

1. An exhaust gas purifier provided in an exhaust line of an engine, said purifier comprising a case, a metallic trapper mounted in said case for trapping particulate material contained in exhaust gas, and an electric heater mounted in said case on a downstream side of said trapper for burning the particulate matter trapped, wherein said trapper is formed with a plurality of recesses alternately penetrating inwardly from the upstream and downstream sides of the trapper, said electric heater being inserted in only one of the recesses penetrating from the downstream into upstream side of the trapper.

2. An exhaust gas purifier as claimed in claim 1 wherein said trapper has a filter portion made of a porous metal.

3. An exhaust purifier as claimed in claim 1 wherein said electric heater comprises a flat, planar-shaped heater element provided opposite to a surface of the filter portion of said trapper on outlet side thereof.

4. An exhaust gas purifier as claimed in claim 1 wherein said recesses are concentrically arranged annular recesses, said electric heater being inserted in the outermost one of the recesses penetrating from the downstream into upstream side of the trapper.

5. An exhaust gas purifier as claimed in claim 1 or 2 wherein said trapper has a filter portion made of a porous metal and having pores whose average diameter is more than 5 $\mu$m.

6. An exhaust gas purifier provided in an exhaust line of an engine, said purifier comprising a case, a metallic trapper mounted in said case for trapping particulate material contained in exhaust gas, and a cylindrical electric heater mounted in said case on a downstream side of said trapper for burning the particulate matter trapped, wherein said trapper is formed with a plurality of recesses alternately penetrating inwardly from the upstream and downstream sides of the trapper, said electric heater being inserted in only one of the recesses penetrating from the downstream into upstream side of the trapper.

* * * * *